US010506861B1

(12) United States Patent
Ma

(10) Patent No.: US 10,506,861 B1
(45) Date of Patent: Dec. 17, 2019

(54) 2-IN-1 NAIL LAMP STATION

(71) Applicant: Carol Ma, Hacienda Heights, CA (US)

(72) Inventor: Carol Ma, Hacienda Heights, CA (US)

( * ) Notice: Subject to any disclaimer, the term of this patent is extended or adjusted under 35 U.S.C. 154(b) by 0 days.

(21) Appl. No.: 16/450,957

(22) Filed: Jun. 24, 2019

Related U.S. Application Data

(63) Continuation-in-part of application No. 16/361,215, filed on Mar. 22, 2019.

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC ..... A45D 29/00; A45D 29/22; A45D 31/00; A45D 34/04; A45D 2200/205; H04N 5/2396; H04N 5/3229; F26B 9/003; F26B 3/28; F26B 23/04
USPC ..... 34/266
See application file for complete search history.

(56) References Cited

U.S. PATENT DOCUMENTS 3,712,312 A * 1/1973 Sussman ..... A45D 29/18 132/73.6
4,206,556 A * 6/1980 Sabo ..... A45D 29/18 132/73.5
4,612,444 A * 9/1986 Ragusa ..... A45D 29/18 118/641
4,987,310 A * 1/1991 Oppawsky ..... A45D 29/18 250/455.11
5,130,551 A * 7/1992 Nafziger ..... A45D 29/18 118/642
6,286,517 B1 * 9/2001 Weber ..... A45D 29/00 132/200
8,061,365 B2 * 11/2011 Rehkemper ..... A45D 29/00 132/73.6
8,312,641 B2 * 11/2012 Li ..... F26B 3/28 118/642
8,667,691 B2 * 3/2014 Gibbs ..... A45D 29/02 132/73.5
9,056,491 B2 * 6/2015 Bitoh ..... B41J 2/49
9,072,357 B2 * 7/2015 Li ..... A45D 29/00
9,810,479 B2 * 11/2017 Haile ..... F26B 3/28
10,247,475 B2 * 4/2019 Valia ..... A45D 29/00
10,357,094 B1 * 7/2019 Luu ..... G21K 5/02
(Continued)

FOREIGN PATENT DOCUMENTS

FR 2 867 970 * 9/2005
JP 9-182619 * 7/1997
(Continued)

*Primary Examiner* — Stephen M Gravini
(74) *Attorney, Agent, or Firm* — Raymond Y. Chan; David and Raymond Patent Firm

(57) ABSTRACT

A nail lamp station includes a base lamp assembly and a detachable lamp pen. The base lamp assembly includes a station housing having a light cavity capable of receiving multiple fingernails therewithin, and a first light source supported within the light cavity for drying nail polishes on the fingernails at the same time within the light cavity. The detachable lamp pen is detachably coupled at the station housing, wherein the detachable lamp pen includes an elongated pen body and a second light source provided at a light end of the pen body for drying the nail polish on one single particular fingernail.

30 Claims, 5 Drawing Sheets

(56) References Cited

U.S. PATENT DOCUMENTS

| | | | | |
|---|---|---|---|---|
| 2013/0025614 | A1* | 1/2013 | Morgan | A61C 15/043 132/200 |
| 2013/0161531 | A1* | 6/2013 | Haile | A45D 29/00 250/455.11 |
| 2015/0265027 | A1* | 9/2015 | Wan | A45D 29/00 34/275 |
| 2015/0289627 | A1* | 10/2015 | Chang | A45D 29/00 34/275 |
| 2016/0095409 | A1* | 4/2016 | Jih | A45D 29/00 34/202 |
| 2016/0095412 | A1* | 4/2016 | Jih | B05C 9/14 34/275 |
| 2018/0023892 | A1* | 1/2018 | Haile | F26B 3/28 250/492.1 |
| 2019/0150585 | A1* | 5/2019 | Ayukawa | A45D 29/18 |
| 2019/0208884 | A1* | 7/2019 | Ortiz | A45D 29/004 |

FOREIGN PATENT DOCUMENTS

| | | | |
|---|---|---|---|
| JP | 2003 109541 | * | 4/2003 |
| WO | WO 01/44378 | * | 6/2001 |

* cited by examiner

2-IN-1 NAIL LAMP STATION

CROSS REFERENCE OF RELATED APPLICATION

This application is a Continuation-In-Part application that claims the benefit of priority under 35 U.S.C. § 120 to a non-provisional application, application Ser. No. 16/361,215 filed Mar. 22, 2019, which is incorporated herewith by reference in its entity.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a nail lamp, and more particularly to a 2-in-1 nail lamp station, which comprises a base lamp assembly for drying nail polishes on multiple nail surfaces of a user's hand or foot, and a detachable lamp pen for drying the nail polish on a particular nail surface of a finger of the user's hand or a toe of the user's foot.

Description of Related Arts

Various methods have been devised to alleviate the burden on individuals applying nail polish to their fingernails or toenails. Particularly, a plurality of nail coatings is orderly applied on the nail surface. For example, a base coat, one or more nail polishing coats, and a protection coat are orderly applied on the nail surface. A nail accessory or decoration, such as jewel or sticker, can be glued on the nail surface before the protection coat is on the nail surface.

It is worth mentioning that all the nail coatings must be dried individually. In particular, in order to dry each nail coating on the nail surface, the nail surface is usually exposed under a LED light or a UV light. Alternatively, instead of directly applying nail polish to the fingernails or toenails, the user may adhere prefabricated nails, made of plastic or gel, to the nail surfaces of the user's hand or foot respectively, and then apply nail polish to the prefabricated nail surface.

For example, the U.S. Pat. No. 8,534,299 suggests a prefabricated nail which is made by mold members made of UV transmissive material such as glass, clear plastic or clear acrylic, and adapted to attach on the nail surface by applying UV radiation through the prefabricated gel nail onto the bonding agent between the nail surface and the prefabricated gel nail. In other words, UV light is usually used for attaching prefabricated nail onto the nail surface of the user too. The inventor of the present invention also suggests an artificial nail tip and curing composition set, U.S. application Ser. No. 15/916,216, which discloses an Extend Gel and Gel-X tip adapted to be adhered on the nail surface by preferably applying LED lighting for just 30 seconds.

A conventional nail lamp generally comprises a light source supported within a light cavity, wherein multiple nail surfaces can be placed under the light source within the light cavity to dry the nail coatings on the nail surfaces at the same time. In other words, the conventional nail lamp provides a relatively large area for the user to conveniently dry the nail coatings on the five nail surfaces, such as drying the base coats on the nail surfaces at the same time. However, the conventional nail lamp has several drawbacks. Since the conventional nail lamp provides the large drying area, the light intensity may not be evenly distributed within the light cavity, such that the nail coatings on the curved nail surfaces may not be dried evenly and completely at the same time. Especially when different nail polishing coatings are applied on different nail surfaces, the nail polishing coatings will be dried unevenly due to the curvature of the nail surfaces, the coating thickness differences and the uneven light distribution. Furthermore, it is difficult for the user to determine the most proper positions to place the fingers for the most relatively even distribution of the light and to pin-point a particular coating area on the nail surface needed to be dried. For example, when a nail jewel is glued on the nail surface, a peripheral edge of the nail jewel must be dried to retain the nail jewel on the nail surface. Likewise, after the protection coat is applied on the nail jewel, the conventional nail lamp cannot effectively dry the nail coating with the irregular contour of the nail jewel. Accordingly, some users may try to use an independent light source, such as battery powered flash light, to apply UV or LED lighting on the desired area of the nail surface of each finger one by one but it will take a lot more time to complete the drying process. However, it will be very discouraging when the user finished the nail polish coating but find the flash light is out of battery.

SUMMARY OF THE PRESENT INVENTION

The invention is advantageous in that it provides a nail lamp station, which is a 2-in-1 station that comprises a base lamp assembly for drying nail polishes on multiple nail surfaces equipped with a detachable lamp pen for drying the nail polish on a particular nail surface, wherein the detachable lamp pen is normally coupled with the base lamp assembly and charged by the base lamp assembly and can be detached from the base lamp assembly for the user to apply lighting to the nail surface independently.

Another advantage of the invention is to provide a nail lamp station, wherein a plurality of anchor points is provided in a curing tray within the lighting cavity of the base lamp assembly facilitating the user to precisely place the nail surfaces at the anchor points respectively for receiving preferred lighting exposure according to the factory arrangement of the light source to ensure the best curing and drying performance thereof.

Another advantage of the invention is to provide a 2-in-1 nail lamp station, wherein the anchor point marks of the base lamp assembly are linked with activation sensor that when a hand is placed onto the curing tray and adjust the fingers to the anchor points, the light will be automatically illuminated for curing and drying performance.

Another advantage of the invention is to provide a 2-in-1 nail lamp station, wherein the base lamp assembly can be selectively powered by external power source and internal power source, wherein the internal power source comprises one or more batteries which enable the user to use the base lamp assembly anywhere even without AC supply and can be charged when external power source, such as AC power supply, is used through adapter.

Another advantage of the invention is to provide a nail lamp station, wherein the detachable lamp pen is automatically charged when it is coupled at the base lamp assembly and is operated in a cable free manner when it is detached from the base lamp assembly.

Another advantage of the invention is to provide a nail lamp station, wherein the detachable lamp pen is magnetically coupled at the base lamp assembly to automatically align the detachable lamp pen for being stored and charged.

Another advantage of the invention is to provide a nail lamp station, wherein a light source of the detachable lamp pen is a single light point capable of generating a focused light to pin-point a desired drying area on the nail surface.

Another advantage of the invention is to provide a nail lamp station, wherein the operation of the detachable lamp pen is easy by simply pointing the light end of the detachable lamp pen toward the nail surface.

Another advantage of the invention is to provide a nail lamp station, which does not involve complicated and expensive mechanical components and processes so that the manufacturing cost of the present invention can be minimized.

Another advantage of the invention is to provide a nail lamp station, wherein no expensive or complicated structure is required to employ in the present invention in order to achieve the above mentioned objects. Therefore, the present invention successfully provides an economic and efficient solution for two different lamp configurations for drying the nail polishes on the nail surfaces and/or curing the attachment of the artificial nail tips on the nail surfaces. For example, the present invention provides two different lamp configurations, including the base light station and the detachable light pen, for drying the nail polish on the nail surface. Likewise, the present invention provides two different nail care configurations, including the base light station and the electric nail file, for different nail surface treatments.

Additional advantages and features of the invention will become apparent from the description which follows, and may be realized by means of the instrumentalities and combinations particular point out in the appended claims.

According to the present invention, the foregoing and other objects and advantages are attained by a nail lamp station, comprising:

a base lamp assembly which comprises a station housing having a light cavity capable of receiving multiple fingernails therewithin, and a first light source supported in the station housing adapted for providing lighting within the light cavity for drying nail polishes or curing the artificial nail tips on the fingernails at the same time within the light cavity; and a detachable nail care tool detachably coupled at the station housing for providing an additional nail care function.

In one embodiment, the handheld nail care tool can be a detachable lamp pen detachably coupled at the station housing, wherein the detachable lamp pen comprises an elongated pen body and a point light source provided at a light end of the pen body for drying the nail polish on one single particular fingernail.

In another embodiment, the handheld nail care tool can be an electric nail file detachable coupled at the station housing for manicuring, pedicuring, shaping, polishing, removing callus, etc.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
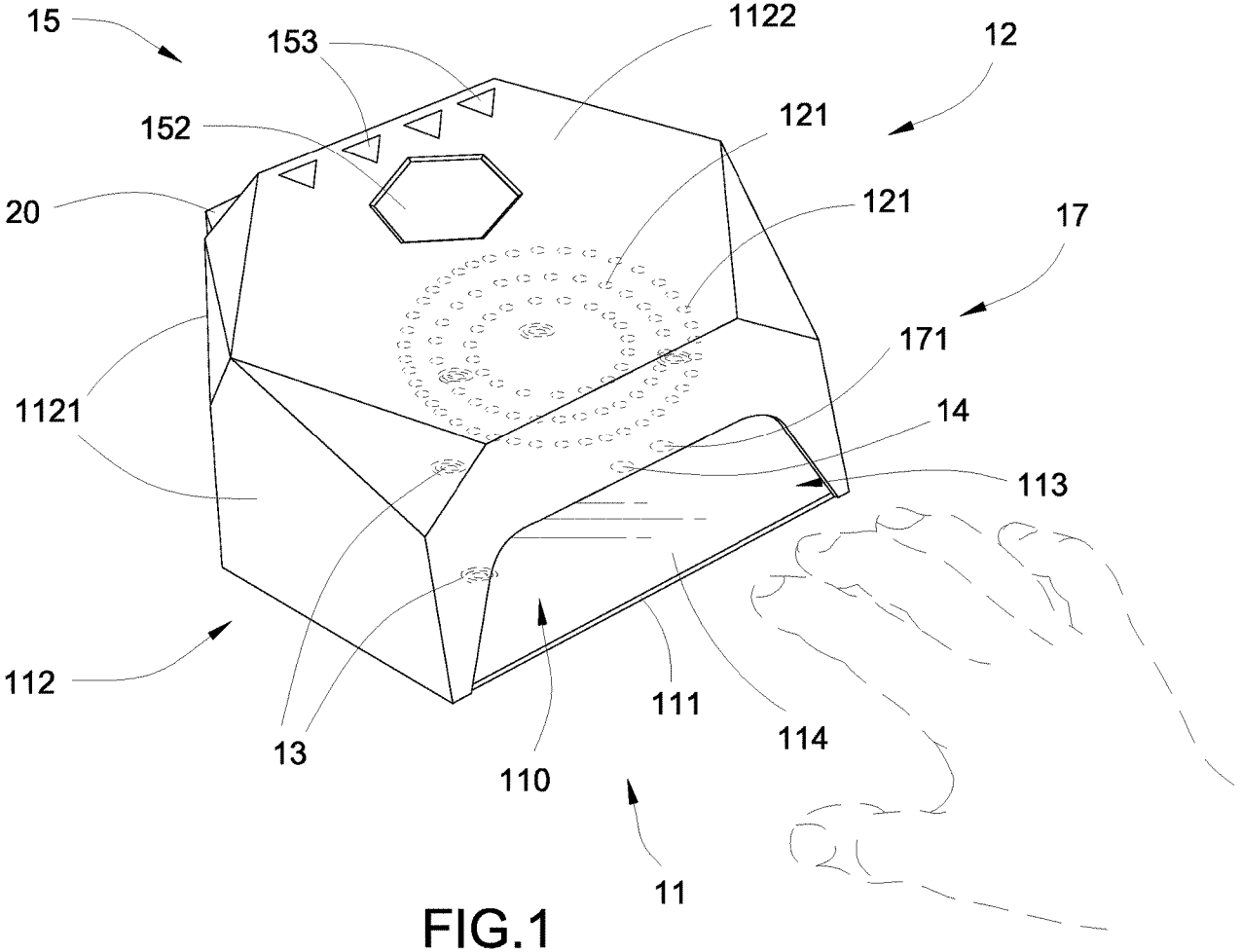
FIG. 1 is a front perspective view of a 2-in-1 nail lamp station according to a preferred embodiment of the present invention.
Figure 2:
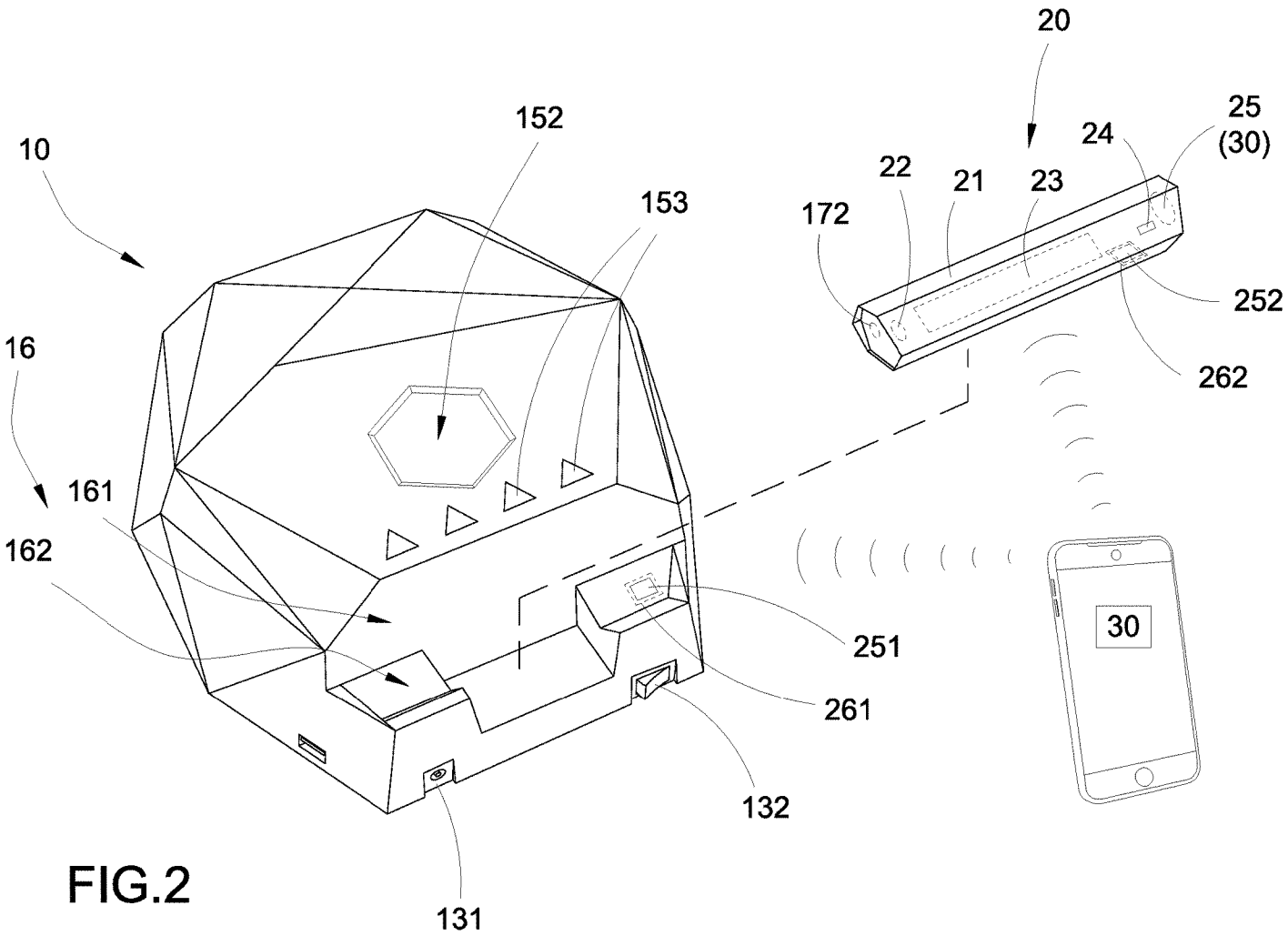
FIG. 2 is an exploded rear perspective view of the 2-in-1 nail lamp station according to the preferred embodiment of the present invention.
Figure 3:
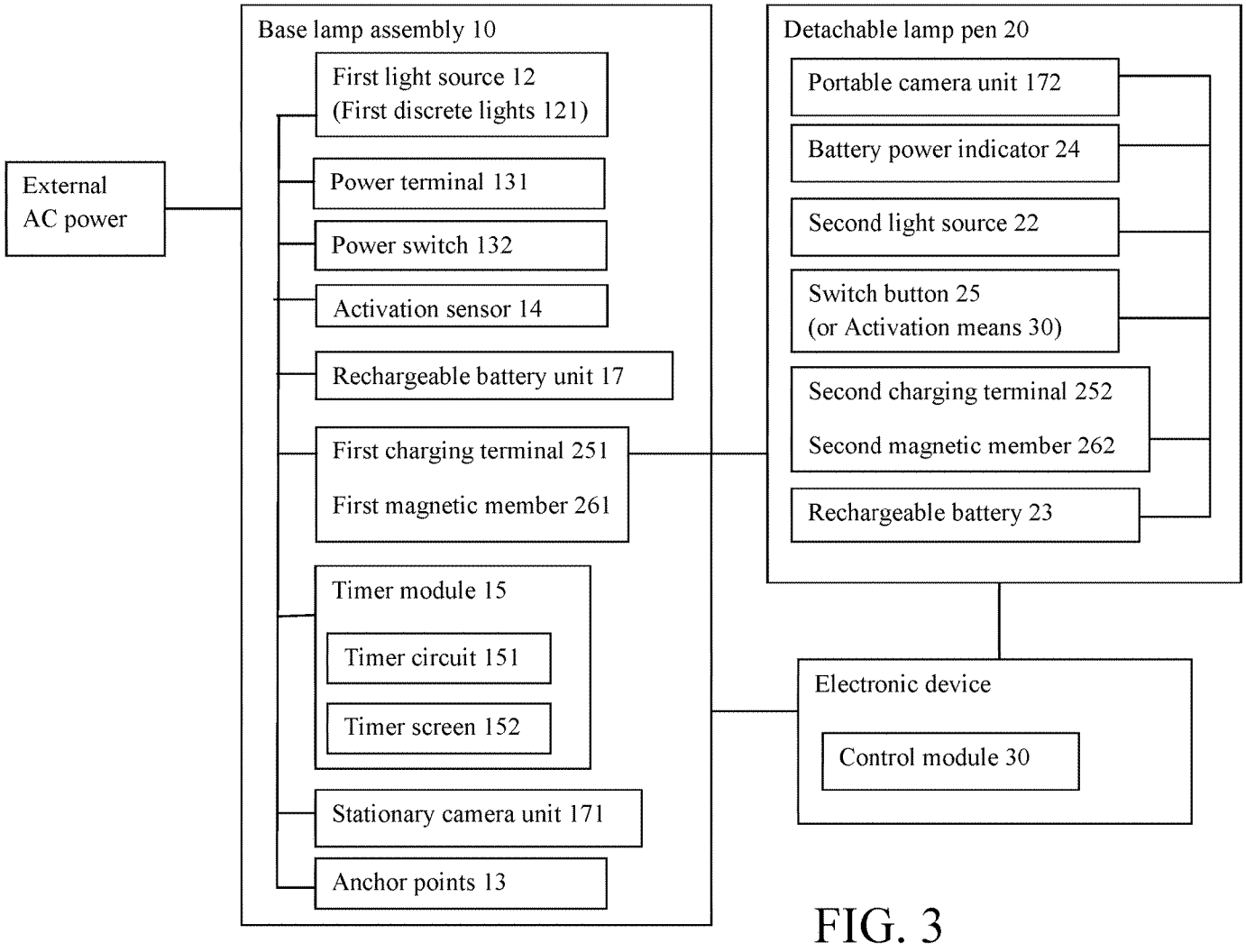
FIG. 3 is a block diagram of the 2-in-1 nail lamp station according to the preferred embodiment of the present invention.
Figure 4:
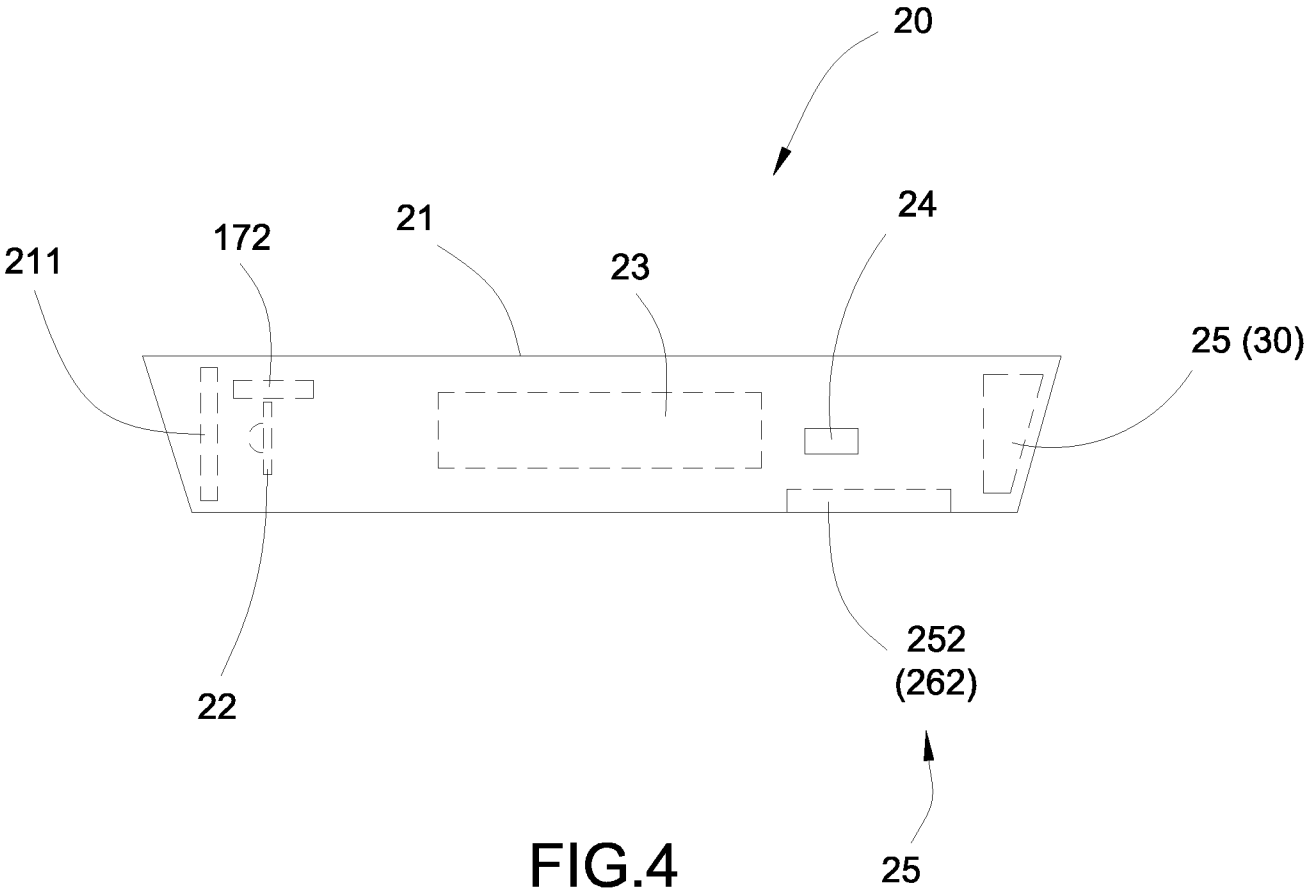
FIG. 4 is a side view of a detachable lamp pen of the 2-in-1 nail lamp station according to the preferred embodiment of the present invention.

Referring to FIGS. 1 to 3 of the drawings, a nail lamp station according to a preferred embodiment of the present invention is illustrated, wherein the nail lamp station of the present invention is arranged for drying nail polish on a nail surface and/or curing artificial nail tip attached on a nail surface. Accordingly, the nail lamp station is a 2-in-1 nail lamp station comprising a base lamp assembly 10 and a handheld nail care tool 20.

According to the preferred embodiment, the base lamp assembly 10 comprises a station housing 11 having a light cavity 110 capable of receiving multiple fingernails therewithin, and a first light source 12 supported in the station housing 11 for illuminating within the light cavity 110 for curing nail surfaces of the user, such as drying nail polishes on the fingernails or curing artificial nail tips to be attached on the fingernails respectively at the same time within the light cavity 110.

According to the preferred embodiment, the handheld nail care tool is a battery-powered tool for providing an additional nail care for the fingernail. In one embodiment, the handheld nail care tool is a detachable lamp pen 20.

The detachable lamp pen 20 is embodied as a single finger lamp. The detachable lamp pen 20 is detachably coupled at the station housing 11, wherein the detachable lamp pen 20 comprises an elongated pen body 21 and a second light source 22 provided at a light end of the pen body 21 for curing nail surface of the user, such as drying the nail polish on one single particular fingernail or curing an artificial nail tip to be attached on a fingernail.

Accordingly, the station housing 11 comprises a base panel 111 and a casing 112 mounted on the base panel 111, wherein the casing 112 is upwardly extended from the base panel to form the light cavity 110 therebetween, wherein the casing 112 has at least a surrounding wall 1121 and a top wall 1122 and the light cavity 110 has an opening 113 formed in the surrounding wall 1121 communicating the light cavity 110 with outside. In other words, the opening 113 is formed at a front side of the surrounding wall 1121 of the casing 112 and the light cavity 110 communicates outside through the opening 113 such that the user can place her or his fingernails inside the light cavity 110 and withdraw her or his fingernails out of the light cavity 110 via the opening 113. The opening 113 is big enough for at least two or more fingernails inserting into the light cavity 110.

The first light source 12 comprises a plurality of first discrete lights 121 spacedly supported by the casing 112 to provide light illuminating within the light cavity 110, wherein the first light source 12 generates curable lights to dry the nail polishes on the fingernails within the light cavity 110 or to cure and attach the artificial nail tip on the fingernails within the light cavity 110. Particularly, the first light source 12 is supported at a ceiling of the light cavity 110 to emit the curable light downwardly towards the base panel 111. Furthermore, a bottom floor of the light cavity 110 formed by the base panel 111 according to the preferred embodiment is a mirror surface for reflecting the light from the first light source 12 within the light cavity 100 and functions as a curing tray for the fingernails to be cured placing thereon. Preferably, according to the preferred embodiment of the present invention, the first light source 12 is a LED light source which performs especially well in curing gel nail polish and gel nail tip within 30 seconds. Alternatively, the first light source 12 can also be the conventional UV light source that can cure the nail polish and artificial nail tip in couple minutes as usual.

The base lamp assembly 10 further comprises a power terminal 131 electrically linked to the first light source 12 for electrically connecting to an external AC power, and a power switch 132 operatively linked to the first light source 12 to switch the first light source 12 in an on-and-off manner.

The base lamp assembly 10 further comprises an activation sensor 14 electrically lined to the first light source for automatically activating the first light source 12 when the activation sensor 14 detects a presence of an object such as a hand or a fingernail within the light cavity 110. Preferably, the activation sensor 14 is located adjacent to the opening 113 of the station housing 11, such that when the hand or fingernail of the user is inserted into the light cavity 110 through the opening 113, the first light source 12 is automatically switched on by the activation sensor 14. Once the object such as the hand or fingernail leaves the light cavity 110 from the opening 113, the first light source 12 is automatically switched off by activation sensor 14. It is worth mentioning that the activation sensor 14 is activated for detecting the presence of the fingernail when the first light source 12 is switched on via the power switch 132.

In order to provide better curing treatment, the fingernails are preferred to be placed on specific positions on the curing tray 114 with respect to the distribution of the LED lights 121 of the first light source 12. Also, when the user is applying nail polish or attaching artificial nail tips on fingernails of both hands by herself or himself for best result and efficiency, an automatic switching on of the first light source 12 is a preferred function to be provided by the present invention. Accordingly, the base lamp assembly 10 further comprises a plurality of anchor points 13 electrically linked with the activation sensor 14 and the first light source 12. The plurality of anchor points 13, at least one and preferably five, is provided on the curing tray 114 in such a manner that when the activation sensor 14 detects one or more fingernails being placed and aligned with one or more of the anchor points 13 respectively, the first light source 12 is activated to switch on and provide light within the light cavity 110, wherein the first light source 12 remains switching on as long as at least one fingernail is detected right on the corresponding anchor point 13, and that the first light source 12 switches off automatically once the activation sensor 14 detects that all the fingernails are removed from the corresponding anchor points 13, or that the first light source 12 remains switching off as long as there is no fingernail be detected on the anchor points 13, while the base lamp assembly 11 is powered on. Alternatively, the activation sensor 14 may comprise one or more touch sensors provided at the anchor points 13 respectively, so that when one or more fingers are placed at the one or more anchor points 13 and touch the touch sensors, the first light source 12 is automatically activated to switch on and when the one or more fingers are removed from the anchor points 13, the first light source 12 is automatically activated to switch off. Therefore, the user has no need to specifically use one hand to switch on and off the first light source 12 and the anchor points 13 substantially encourage and guide the user to place her or his fingernails on the suggested positions (i.e. the anchor points 13) respectively so as to receive relatively more even lighting illumination from the first light source 12 for the best curing effect for drying the nail polish or curing the artificial nail tips on the nail surfaces of the user.

As mentioned above, the activation sensor 14 electrically linked with the first light source 12 can be simply provided at the opening 113 of the casing 112 such that the first light source 12 is activated to switch on for illuminating within the light cavity 110 when the object such as the hand or finger is detected at the opening 113 and switch off when no object is detected at the opening 113, or that, alternatively, the activation sensor 14 can be provided in the light cavity 110 such that the first light source 12 is activated to switch on for illuminating within the light cavity 110 when an object is detected to be placed inside the light cavity 110 and switch off when no object is detected within the light cavity 110, so that the user has no need to switch on and off the first light source 12 manually. Accordingly, in such mode, the anchor points 13 can be simply marks provided on the curing tray 114 without electrically linked with the sensor unit 14.

According to the preferred embodiment, the base lamp assembly 10 further comprises a timer module 15 which comprises a timer circuit 151 operatively linked to the first light source 12 for setting an activation time interval thereof, and a timer screen 152 provided on the station housing 11 for displaying the activation time interval. Preferably, a plurality of timer setters 153 are provided on the station housing 11 as a time interval input to set the time interval. For example, the user sets 30 seconds as the activation time interval, wherein when the activation sensor 14 detects a presence of the fingernail(s) within the light cavity 110 to switch on the first light source 12, after 30 seconds of the activation time interval, an alert can be provided to remind the user the curing process is completed and to remove fingernail(s) from the light cavity 11, or that the first light source 12 may also be automatically switched off, so as to avoid over curing.

According to the preferred embodiment, the base lamp assembly 10 may further comprise a rechargeable battery unit 17 supported in the station housing 11 and electrically connected with the first light source 12 so as to supply battery power to the first light source 12 for illumination within the light cavity 110 when the AC external power is disconnected so as to enable the base lamp assembly 10 becoming a portable device that the user may use it elsewhere have no power supply. The rechargeable battery unit 17 is charged automatically by the AC external power whenever the AC external power is connected to the base lamp assembly 10. Battery level light 161 can be provided on the station housing 11 to illustrate the level of battery power to the user for timely charging operation to ensure enough power supply to complete the fingernail curing treatment.

According to the preferred embodiment, the detachable lamp pen 20 is detachably coupled at the station housing 11, such as a rear top side of the station housing 11. A shown in FIG. 2, the station housing 11 further has a holding compartment 16 formed thereon at a position opposite to the opening 113 of the light cavity 110, such that the pen body 21 is retained at the holding compartment 16 of the station housing 11. Particularly, the holding compartment 16 is formed at the rear top side of the top casing 112 of the station housing 11. It is appreciated that the holding compartment 16 can also be formed at the top side or surrounding side of the casing 112. Person skilled in the art may also modify the holding compartment as a docket unit connected to or extended from the station housing 11 for retaining the pen body 21 of the detachable lamp pen 20. The holding compartment 16 can be a specific area provided on the station housing 11 and shaped and sized for retaining the detachable lamp pen 20 thereon As shown in FIG. 2, according to the preferred embodiment, the holding compartment 16, having a L-shaped cross section, is formed at the rear top side of the top casing 112 of the station housing 11, such that the holding compartment 16 forms an open slot configuration shaped and sized to receive the detachable lamp pen 20. With the open slot configuration, the user is able to easily place and/or remove the detachable lamp pen 20 at the holding compartment 16. The holding compartment 16 has an upright aligning side 161 and a horizontal resting side 162, such that the pen body is guided and supported via the aligning side 161 and the resting side 162 of the holding compartment 16 respectively. Preferably, the pen body 21 of the detachable lamp pen 20 has a non-circular cross section that two circumferential sides thereof are correspondingly biased against the aligning side 161 and the resting side 162 of the holding compartment 16 respectively.

According to the preferred embodiment, the detachable lamp pen 20 further comprises a rechargeable battery 23 supported within the pen body 21 and electrically connected with the second light source 22, and a battery power indicator 24 provided at the pen body 21 to electrically link to the rechargeable battery 23 for indicating an electrical level thereof. Therefore, when the battery power indicator 24 indicates the low battery power of the rechargeable battery 23, the user should recharge the rechargeable battery 23 with an external charger or preferably by the base lamp assembly 10 by placing back to the holding compartment 16 before the detachable lamp pen 20 is operated again.

Alternatively, an electrical cable can be used to electrically connect the detachable lamp pen 20 with the base lamp assembly 10 for electrical power supply to the detachable lamp pen 20. For application convenience, a wireless detachable lamp pen 20 is preferred.

When the rechargeable battery 23 is charged, the user is able to switch on the second light source 22 to emit the curable light for operation. In other words, the user is able to operate the detachable lamp pen 20 in a cable free manner. In order to charge the rechargeable battery 23 by the base lamp assembly 10, the detachable lamp pen 20 further comprises a first charging terminal 251 provided at the station housing 11 to electrically link to the an external AC power, and a second charging terminal 252 provided at the pen body 21 to electrically link to the rechargeable battery 23. When the second terminal 252 is electrically contacted with the first terminal 251, the rechargeable battery 23 is automatically charged by the AC external power electrically connected to the base lamp assembly 10 or by the rechargeable battery unit 17 of the base lamp assembly 10 when it is disconnected with the AC external power. It is worth mentioning that, for example, the power switch 132 should be switched on to charge the rechargeable battery 23. In other words, when the power switch 132 is switched off, the rechargeable battery 23 will not be charged even the second terminal 252 is electrically contacted with the first terminal 251.

As shown in FIG. 2, the first charging terminal 251 is provided at the holding compartment 16, such that the rechargeable battery 23 is charged when the pen body 21 is retained at the holding compartment 16 of the station housing 11. In particular, the first charging terminal 251 is provided on the resting side 162 of the holding compartment 16 and the second charging terminal 252 is provided on the circumferential side of the pen body 21, such that when the pen body 21 is rested on the resting side of the holding compartment 16, the second terminal 252 is electrically contacted with the first terminal 251 to charge the rechargeable battery 23 by the external power supply or the rechargeable battery unit 17.

According to the preferred embodiment, it is appreciated that the rechargeable battery 23 also forms a power supply for the first light source 12 when the pen body 21 is retained at the holding compartment 16 of the station housing 11 and when the power terminal 131 is electrically disconnected with the external AC power. In case of there is no rechargeable battery unit 17 provided in the base lamp assembly 10 or the rechargeable battery unit 17 is drain and the user cannot find any external AC power to connect the base lamp assembly 10, the first light source 12 and the second light source 22 can be powered by the rechargeable battery 23 of the detachable lamp pen 20 via the electrically contact between the first and second charging terminals 251, 252, so that the rechargeable battery 23 becomes a secondary or supplemental power supply to the base lamp assembly 10. In other words, the first light source 12 can be powered on when the detachable lamp pen 20 is received at the holding compartment 16 of the base lamp assembly 10. The second light source 22 can be powered on when the detachable lamp pen 20 is detached from the holding compartment 16 of the base lamp assembly 10.

Furthermore, the detachable lamp pen 20 further comprises at least a first magnetic member 261 provided at the station housing 11 of the base lamp assembly 10 and at least a second magnetic member 262 provided at the pen body 21 to magnetically attract to the first magnetic member 26 so as to guide the detachable lamp pen 20 retaining at the holding compartment 16 of the base lamp assembly 10 and automatically align the second charging terminal 252 with the first charging terminal 251 for electrically connecting the first charging terminal 251 with the second charging terminal 252. According to the preferred embodiment, the first magnetic member 261 is provided on the resting side 162 of the holding compartment 16, so as to magnetically attract with the second magnetic member 262 of the detachable lamp pen 20 to retain the detachable lamp pen 20 in position in the holding compartment 16 while the first and second charging terminals 251, 252 are aligned with each other and retained in electrical contact.

Preferably, the first and second charging terminals 251, 252 are contacted with each other via magnetic engagement that the first and second charging terminals 251, 252 are two magnetic members respectively. In other words, the first and second magnetic members 261, 262 are integrated with the first and second charging terminals 251, 252. Or, the first and second charging terminals 251, 252 are made of magnetic material to function as the first and second magnetic members 261, 262 too.

As shown in FIG. 3, the pen body 21 has an elongated structure and has a polygonal cross section to enable the user to hold the pen body 21 ergonomically. The pen body 21 further has a light window 211 formed at the light end of the pen body 21 to align with the second light source 22.

Accordingly, the second light source 22 is a single light point for generating a focused curable light from the light end of the pen body 21. Likewise, the second light source 22 is preferred be a LED light source and/or, alternatively, a UV light source. Therefore, the second light source 22 of the detachable lamp pen 20 is able to generate the focused light to pin-point a drying area on the nail surface or a curing area of the artificial nail tip attached on the nail surface. In other words, the user is able to easily operate the detachable lamp pen 20 by simply pointing the light end of the pen body 21 of the detachable lamp pen 20 toward the nail surface or artificial nail tip of the fingernail.

As shown in FIG. 3, the pen body 20 further has a switch end opposed to the light end thereof, wherein a switch button 25 is provided at the switch end of the pen body 20 to selectively control the second light source 22 in an on-and-off manner. Preferably, the light end and the switch end of the pen body 20 are two slanted surfaces. Therefore, the user is able to ergonomically hold the pen body 21 at an angle with respect to the nail surface to project the curable light from the second light source 22 to the particular area on the nail surface through the light window 211.

In some embodiments, the detachable lamp pen 20 may not provide with the switch button 25 but has an activation means 30 for automatically switching on the second light source 22 once the detachable lamp pen 20 is detached from the holding compartment 16, i.e. the first and second charging terminals 251, 252 are detached from each other or the first and second magnetic members 261, 262 are detached from each other. In addition, the activation means 30 is also arranged for automatically switching off the second light source 22 once the detachable lamp pen 20 is retained at the holding compartment 16, i.e. the first and second charging terminals 251, 252 are contacted with each other or the first and second magnetic members 261, 262 are attracted with each other.

Accordingly, the user is able to detach the detachable lamp pen 20 from the base lamp assembly 10. With the mobility design of the detachable lamp pen 20, the user is able operate the detachable lamp pen 20 in a cable free manner in order to pre-cure the nail polish on the fingernail or the artificial nail tip attached on the fingernail. Especially for the irregular or different sculptures on the nail surface, the light from the detachable lamp pen 20 can be pin pointed on a particular area of the nail surface to pre-cure the nail polish or the artificial nail tip. Then, the user is able to insert the fingernail into the light cavity 110 to fully cure the nail polish or the attachment of the artificial nail tip.

The base lamp assembly 10 further comprises a camera module 17 for capturing nail images. The camera module 17 comprises a stationary camera unit 171 provided at the station housing 11 and electrically connected to the power terminal 131. Preferably, the stationary camera unit 171 is supported within the light cavity 110 for capturing the nail images when the user inserts the fingernail into the light cavity 110 through the front opening to dry the nail polishes. In one embodiment, video will be taken by the stationary camera unit 171 that video clips are recorded, such that the user is able to view the video clips. Preferably, the video clips can be uploaded to a server, such that the user is able to access the server to view the video clips. Accordingly, the stationary camera unit 171 is operatively linked to the power terminal 131, wherein the stationary camera unit 171 is able to capture the nail images to determine the nail drying condition of the nail polish. Once the nail polish is dried via the analysis of the nail images, the main light source 12 will be automatically switched off.

In addition, the camera module 17 further comprises a portable camera unit 172 provided at the light end of the pen body 21 and electrically connected to the rechargeable battery 23 for capturing the nail images when simply pointing the light end of the pen body 21 of the detachable lamp pen 20 toward the nail surface. Likewise, video will be taken by the portable camera unit 172 that video clips are recorded, such that the user is able to view the video clips. It is worth mentioning that each of the stationary camera unit 171 and the portable camera unit 172 can be a clinical photography device for analyzing nail health. Once the nail images are captured, the user is able to view the nail images anytime to view the nail condition. A program can be provided in the server to analyze the nail images to determine the health condition of the nail, such as nail pitting, nail clubbing, spoon nails, and the like. In other words, the detachable lamp pen 20 also forms a portable nail analyzing device for determining the nail condition of the user. A nail condition result will be provided for the user to review after the nail treatment and/or a real-time user technical support information and guiding information will be provided to the user.

The nail station of the present invention further comprises a control module 30 operatively linked to the base lamp assembly 10 and the handheld nail care tool. Accordingly, the control module 30 is wirelessly linked to the base lamp assembly 10 and the detachable lamp pen 20 to collect operation data thereof. The operation data, such as usage time, duration time, user identity, battery power, and other related information, of the base lamp assembly 10 and the detachable lamp pen 20 will be wirelessly sent to the control module 30. In one embodiment, the control module 30 can be an application or software adapted to be downloaded and installed into a user electronic device, such as computer or smart phone. The control module 30 can be wirelessly connected to the base lamp assembly 10 and the detachable lamp pen 20 through a wireless connection such as "Bluetooth", "Wi-Fi", "4G", 5G", or the like. For example, when the activation sensor 14 is activated to switch on and off the main light source 12, the activation signal of the main light source 12 as one of the operation data will wirelessly send to the control module 30. The time interval of the timer module 15, as another operation data, will also wirelessly send to the control module 30. The on-off signal of the detachable lamp pen 20 will wirelessly send to the control module 30. After the operation data is wirelessly sent to the control module 30, the operation data will be saved and a usage report will be generated by the control module 30 to the user. The user is able to login the control module 30, via the electronic device, to view the information of the base lamp assembly 10 and the detachable lamp pen 20.

It is worth mentioning that the control module 30 is wirelessly linked to the camera module 17, wherein the nail images from the stationary camera unit 171 and the portable camera unit 172 will wirelessly send to the control module 30 and will be saved in the electronic device. Therefore, the nail condition result, and/or a real-time user technical support information and guiding information will be provided to the user via the electronic device.

Figure 5:
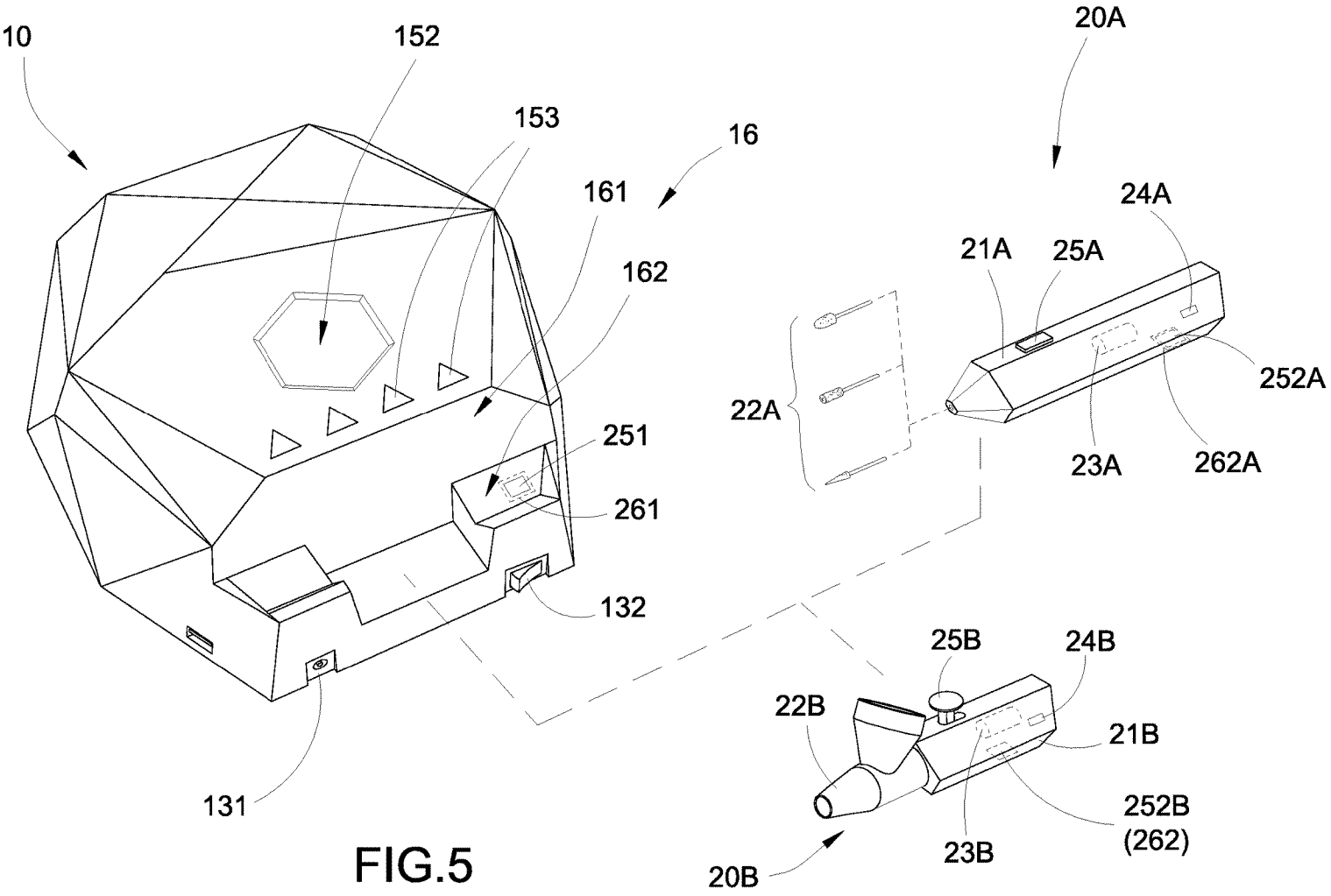
FIG. 5 illustrates an alternative mode of the handheld nail care tool of the 2-in-1 nail lamp station according to the preferred embodiment of the present invention.

FIG. 5 illustrates an alternative mode of the handheld nail care tool which is embodied as an electric nail file 20A detachably coupled at the station housing 11, wherein the electric nail file 20A comprises an elongated pen body 21A and a file head 22A provided at an end of the pen body 21A for nail surface treatment. The electric nail file 20A further comprises a rechargeable battery 23A, a battery power indicator 24A, a second charging terminal 252A electrically contacting with the first charging terminal 251 to charge the rechargeable battery 23A, and a switch button 25A to switch on and off the file head 22A. Accordingly, the file head 22A is a motor-powered file head electrically connected to the rechargeable battery 23A, wherein the file head 22A comprises a plurality of detachable head units detachably coupled to the end of the pen body 21A for manicuring, pedicuring, shaping, polishing, removing callus, etc. The detachable head units can be a nail drill bit and/or different nylon wheels.

Furthermore, the handheld nail care tool can be as an electric airbrush applicator 20B detachably coupled at the station housing 11, wherein the electric airbrush applicator 20B comprises an elongated pen body 21A and an airbrush head 22B provided at an end of the pen body 21B for applying a nail polish on the nail surface. The electric airbrush applicator 20B further comprises a rechargeable battery 23B, a battery power indicator 24B, a second charging terminal 252B electrically contacting with the first charging terminal 251 to charge the rechargeable battery 23B, and a switch button 25B to switch on and off the airbrush head 22B.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A nail lamp station, comprising:

a base lamp assembly which comprises a station housing, which has a light cavity capable of receiving one or more fingernails therewithin and an opening communicating said light cavity with outside, and a first light source supported and supplied with electrical power in said station housing for illuminating within said light cavity for selectively drying nail polishes on fingernails or curing artificial nail tip attached on the fingernails at the same time within said light cavity, wherein said station housing of base lamp assembly further has a holding compartment provided thereon; and a detachable lamp pen detachably coupled at said holding compartment of said station housing, wherein said detachable lamp pen comprises an elongated pen body having a shape and size adapted to be retained in said holding compartment, a battery, and a second light source provided at a light end of said pen body and electrically connected with said battery for electrical power supply, wherein said detachable lamp pen is detachable from said holding compartment and switched on said second light source for applying light pointing at a particular area of one single particular fingernail for selectively drying a nail polish on the one single particular fingernail or curing the artificial nail tip attached on the one single particular fingernail.

2. The nail lamp station, as recited in claim 1, wherein said holding compartment has an open slot configuration formed on a side of said station housing, wherein said holding compartment has an upright aligning side and a horizontal resting side, such that said pen body is guided and supported via said aligning side and said resting side of said holding compartment respectively.

3. The nail lamp station, as recited in claim 1, wherein said base lamp assembly further comprises a power terminal electrically linked to said first light source for electrically connecting to an external AC power, wherein said battery of said detachable lamp pen is a rechargeable battery supported within said pen body to electrically connect with said second light source, wherein said detachable lamp pen further comprises a first charging terminal provided at said holding compartment of said station housing to electrically link to said power terminal for power supplying from the external AC power, and a second charging terminal provided at said pen body to electrically link to said rechargeable battery thereof and arranged in such a manner that when said pen body is retained at said holding compartment of the station housing, said second charging terminal is electrically connected with said first charging terminal to charge said rechargeable battery.

4. The nail lamp station, as recited in claim 2, wherein said base lamp assembly further comprises a power terminal electrically linked to said first light source for electrically connecting to an external AC power, wherein said battery of said detachable lamp pen is a rechargeable battery supported within said pen body to electrically connect with said second light source, wherein said detachable lamp pen further comprises a first charging terminal provided at said holding compartment of said station housing to electrically link to said power terminal for power supplying from the external AC power, and a second charging terminal provided at said pen body to electrically link to said rechargeable battery thereof and arranged in such a manner that when said pen body is retained at said holding compartment of the station housing, said second charging terminal is electrically connected with said first charging terminal to charge said rechargeable battery.

5. The nail lamp station, as recited in claim 3, wherein said rechargeable battery forms a power supply for said first light source through said first and second charging terminals when said pen body is retained at said holding compartment of said station housing and when said power terminal is electrically disconnected with the external AC power.

6. The nail lamp station, as recited in claim 4, wherein said rechargeable battery forms a power supply for said first light source through said first and second charging terminals when said pen body is retained at said holding compartment of said station housing and when said power terminal is electrically disconnected with the external AC power.

7. The nail lamp station, as recited in claim 1, wherein said detachable lamp pen further comprises a first magnetic member provided at said holding compartment of said station housing and a second magnetic member provided at said pen body to magnetically attract to said first magnetic member so as to automatically align said second charging terminal with said first charging terminal and guide said detachable lamp pen to retain at said holding compartment of said station housing of said base lamp assembly in position.

8. The nail lamp station, as recited in claim 2, wherein said detachable lamp pen further comprises a first magnetic member provided at said holding compartment of said station housing and a second magnetic member provided at said pen body to magnetically attract to said first magnetic member so as to automatically align said second charging terminal with said first charging terminal and guide said detachable lamp pen to retain at said holding compartment of said station housing of said base lamp assembly in position.

9. The nail lamp station, as recited in claim 3, wherein said detachable lamp pen further comprises a first magnetic member provided at said holding compartment of said station housing and a second magnetic member provided at said pen body to magnetically attract to said first magnetic member so as to automatically align said second charging terminal with said first charging terminal and guide said detachable lamp pen to retain at said holding compartment of said station housing of said base lamp assembly in position.

10. The nail lamp station, as recited in claim 4, wherein said detachable lamp pen further comprises a first magnetic member provided at said holding compartment of said station housing and a second magnetic member provided at said pen body to magnetically attract to said first magnetic member so as to automatically align said second charging terminal with said first charging terminal and guide said detachable lamp pen to retain at said holding compartment of said station housing of said base lamp assembly in position.

11. The nail lamp station, as recited in claim 5, wherein said detachable lamp pen further comprises a first magnetic member provided at said holding compartment of said station housing and a second magnetic member provided at said pen body to magnetically attract to said first magnetic member so as to automatically align said second charging terminal with said first charging terminal and guide said detachable lamp pen to retain at said holding compartment of said station housing of said base lamp assembly in position.

12. The nail lamp station, as recited in claim 6, wherein said detachable lamp pen further comprises a first magnetic member provided at said holding compartment of said station housing and a second magnetic member provided at said pen body to magnetically attract to said first magnetic member so as to automatically align said second charging terminal with said first charging terminal and guide said detachable lamp pen to retain at said holding compartment of said station housing of said base lamp assembly in position.

13. The nail lamp station, as recited in claim 3, further comprising an activation means for automatically switching on said second light source once said first and second charging terminals are detached from each other and switching off said second light source once said first and second charging terminals are contacted with each other.

14. The nail lamp station, as recited in claim 9, further comprising an activation means for automatically switching on said second light source once said first and second magnetic members are detached from each other and switching off said second light source once said first and second magnetic members are attracted with each other.

15. The nail lamp station, as recited in claim 3, wherein said second light source is a single light point for generating a focused light from said light end of said pen body and said light end of said pen has a slanted surface.

16. The nail lamp station, as recited in claim 9, wherein said second light source is a single light point for generating a focused light from said light end of said pen body and said light end of said pen has a slanted surface.

17. The nail lamp station, as recited in claim 1, wherein said base lamp assembly further comprises an activation sensor electrically lined to said first light source for automatically activating said first light source when said activation sensor detects a presence of one or more fingernails within the light cavity.

18. The nail lamp station, as recited in claim 3, wherein said base lamp assembly further comprises an activation sensor electrically lined to said first light source for automatically activating said first light source when said activation sensor detects a presence of one or more fingernails within the light cavity.

19. The nail lamp station, as recited in claim 4, wherein said base lamp assembly further comprises an activation sensor electrically lined to said first light source for automatically activating said first light source when said activation sensor detects a presence of one or more fingernails within the light cavity.

20. The nail lamp station, as recited in claim 9, wherein said base lamp assembly further comprises an activation sensor electrically lined to said first light source for automatically activating said first light source when said activation sensor detects a presence of one or more fingernails within the light cavity.

21. The nail lamp station, as recited in claim 10, wherein said base lamp assembly further comprises an activation sensor electrically lined to said first light source for automatically activating said first light source when said activation sensor detects a presence of one or more fingernails within the light cavity.

22. The nail lamp station, as recited in claim 18, wherein said first light source is provided at a ceiling of said light cavity while a bottom floor of said light cavity is a mirror surface for reflecting light from said first light source within said light cavity, wherein said activation sensor is provided at said opening of said light cavity.

23. The nail lamp station, as recited in claim 19, wherein said first light source is provided at a ceiling of said light cavity while a bottom floor of said light cavity is a mirror surface for reflecting light from said first light source within said light cavity, wherein said activation sensor is provided at said opening of said light cavity.

24. The nail lamp station, as recited in claim 20, wherein said first light source is provided at a ceiling of said light cavity while a bottom floor of said light cavity is a mirror surface for reflecting light from said first light source within said light cavity, wherein said activation sensor is provided at said opening of said light cavity.

25. The nail lamp station, as recited in claim 21, wherein said first light source is provided at a ceiling of said light cavity while a bottom floor of said light cavity is a mirror surface for reflecting light from said first light source within said light cavity, wherein said activation sensor is provided at said opening of said light cavity.

26. The nail lamp station, as recited in claim 17, wherein said base lamp assembly further comprises a plurality of anchor points electrically linked with said activation sensor and said first light source, wherein said anchor points are provided on a curing tray provided in said light cavity such that when said activation sensor detects one or more fingernails being placed and aligned with one or more of said anchor points respectively, said first light source is activated to switch one and provide light within said light cavity, wherein said first light source remains switching on as long as at least one of the fingernail is detected by said activation sensor right on at least one of said anchor points, and that said first light source switches off automatically once said activation sensor detects that on fingernail is place on said anchor points.

27. The nail lamp station, as recited in claim 18, wherein said base lamp assembly further comprises a plurality of anchor points electrically linked with said activation sensor and said first light source, wherein said anchor points are provided on a curing tray provided in said light cavity such that when said activation sensor detects one or more fingernails being placed and aligned with one or more of said anchor points respectively, said first light source is activated to switch one and provide light within said light cavity, wherein said first light source remains switching on as long as at least one of the fingernail is detected by said activation sensor right on at least one of said anchor points, and that said first light source switches off automatically once said activation sensor detects that on fingernail is place on said anchor points.

28. The nail lamp station, as recited in claim 19, wherein said base lamp assembly further comprises a plurality of anchor points electrically linked with said activation sensor and said first light source, wherein said anchor points are provided on a curing tray provided in said light cavity such that when said activation sensor detects one or more fingernails being placed and aligned with one or more of said anchor points respectively, said first light source is activated to switch one and provide light within said light cavity, wherein said first light source remains switching on as long as at least one of the fingernail is detected by said activation sensor right on at least one of said anchor points, and that said first light source switches off automatically once said activation sensor detects that on fingernail is place on said anchor points.

29. The nail lamp station, as recited in claim 20, wherein said base lamp assembly further comprises a plurality of anchor points electrically linked with said activation sensor and said first light source, wherein said anchor points are provided on a curing tray provided in said light cavity such that when said activation sensor detects one or more fingernails being placed and aligned with one or more of said anchor points respectively, said first light source is activated to switch one and provide light within said light cavity, wherein said first light source remains switching on as long as at least one of the fingernail is detected by said activation sensor right on at least one of said anchor points, and that said first light source switches off automatically once said activation sensor detects that on fingernail is place on said anchor points.

30. The nail lamp station, as recited in claim 21, wherein said base lamp assembly further comprises a plurality of anchor points electrically linked with said activation sensor and said first light source, wherein said anchor points are provided on a curing tray provided in said light cavity such that when said activation sensor detects one or more fingernails being placed and aligned with one or more of said anchor points respectively, said first light source is activated to switch one and provide light within said light cavity, wherein said first light source remains switching on as long as at least one of the fingernail is detected by said activation sensor right on at least one of said anchor points, and that said first light source switches off automatically once said activation sensor detects that on fingernail is place on said anchor points.

* * * * *